US011067333B2

(12) United States Patent
Drotleff et al.

(10) Patent No.: US 11,067,333 B2
(45) Date of Patent: Jul. 20, 2021

(54) REFRIGERATION APPLIANCE WITH A NOISE SENSOR

(71) Applicant: BSH HAUSGERAETE GMBH, Munich (DE)

(72) Inventors: Horst Drotleff, Aalen (DE); Daniel Micko, Kosice (SK); Adolf Feinauer, Giengen (DE); Matthias Mrzyglod, Ulm (DE); Niels Liengaard, Ulm (DE)

(73) Assignee: BSH Hausgeraete GmbH, Munich (DE)

( * ) Notice: Subject to any disclaimer, the term of this patent is extended or adjusted under 35 U.S.C. 154(b) by 70 days.

(21) Appl. No.: 16/346,556

(22) PCT Filed: Oct. 20, 2017

(86) PCT No.: PCT/EP2017/076817

§ 371 (c)(1),
(2) Date: May 1, 2019

(87) PCT Pub. No.: WO2018/082937

PCT Pub. Date: May 11, 2018

(65) Prior Publication Data

US 2019/0257575 A1 Aug. 22, 2019

(30) Foreign Application Priority Data

Nov. 4, 2016 (DE) ..... 102016221616.3

(51) Int. Cl.
*F25D 29/00* (2006.01)

(52) U.S. Cl.
CPC ..... *F25D 29/00* (2013.01); *F25B 2500/12* (2013.01); *F25D 2700/00* (2013.01)

(58) Field of Classification Search
CPC ..... F25B 2500/13; F25B 2500/12; F25D 2700/00; F25D 29/00
See application file for complete search history.

(56) References Cited

U.S. PATENT DOCUMENTS 5,203,178 A * 4/1993 Shyu ..... F04C 28/28 417/14
5,582,013 A * 12/1996 Neufeld ..... F16F 15/02 60/520

(Continued)

FOREIGN PATENT DOCUMENTS

CN 103080676 A 5/2013
KR 20010081331 A 8/2001

(Continued)

OTHER PUBLICATIONS

Translation of WO-2012130743-A2 (Year: 2012).*

*Primary Examiner* — Marc E Norman
*Assistant Examiner* — Schyler S Sanks
(74) *Attorney, Agent, or Firm* — Laurence A. Greenberg; Werner H. Stemert; Ralph E. Locher

(57) ABSTRACT

A refrigeration device has an electrical device part which emits noise during operation. A controller operates the electrical device part in a normal operating power range. A noise sensor detects an intensity of the emitted noise from the electrical device part. The controller is configured to change an operating power of the electrical device part within the normal operating power range and to determine a minimum value of the noise intensity which is detected by the noise sensor and to determine a noise-reduced operating power in order to operate the electrical device part at the noise-reduced operating power.

17 Claims, 4 Drawing Sheets

(56) References Cited

U.S. PATENT DOCUMENTS

| | | | | |
|---|---|---|---|---|
| 9,470,451 | B2 | 10/2016 | Kim et al. | |
| 2005/0223725 | A1 | 10/2005 | Crane et al. | |
| 2014/0278434 | A1 * | 9/2014 | Martin | H04M 3/4938 704/270.1 |

FOREIGN PATENT DOCUMENTS

| | | | | |
|---|---|---|---|---|
| KR | 20060123925 | A | 12/2006 | |
| KR | 20110014857 | A | 2/2011 | |
| KR | 20150098085 | A | 8/2015 | |
| WO | 2012130743 | A2 | 10/2012 | |
| WO | WO-2012130743 | A2 * | 10/2012 | F25B 49/022 |

* cited by examiner

REFRIGERATION APPLIANCE WITH A NOISE SENSOR

BACKGROUND OF THE INVENTION

Field of the Invention

The present invention relates to a refrigeration appliance with a noise sensor, in particular a refrigeration appliance with a noise sensor for adaptive noise reduction.

A cooling region of a refrigeration appliance is cooled during operation of a refrigerant circuit of said refrigeration appliance. The refrigerant circuit comprises inter alia a refrigerant compressor for compressing refrigerant and a refrigerant condenser for condensing refrigerant. To ensure an effective supply of air to the refrigerant condenser, the refrigeration appliance has a fan for supplying air to the refrigerant condenser. During operation of the refrigeration appliance electrical components of the refrigeration appliance, for example the refrigerant compressor of the refrigerant circuit and/or the fan, produce noise. Depending on the cooling capacity of the refrigerant circuit the noise emitted can be of such an intensity that it can be experienced as unpleasant or annoying by someone in proximity to the refrigeration appliance.

WO 2012/130743 A2 discloses a refrigeration appliance with a module that influences noise emission for different operating parameters and a control unit for varying the operating parameters.

KR 20010081331 discloses a control method for noise-reduced operation of a refrigerator.

SUMMARY OF THE INVENTION

It is the object of the present invention to specify a refrigeration appliance, with which effective noise reduction can be brought about.

Said object is achieved by the subject matter having the features set out in the independent claims. Advantageous embodiments are set out in the dependent claims, the description and the drawings.

According to a first aspect the inventive object is achieved by a refrigeration appliance with an electrical component, which emits noise during operation, a noise sensor for detecting an intensity of the noise emitted by the electrical component and a controller for operating the electrical component in a normal operating power range, wherein the controller is configured to change an operating power of the electrical component within the normal operating power range and to determine a minimum for the noise intensity detected by the noise sensor and to determine a noise-reduced operating power, in order to operate the electrical component with the noise-reduced operating power.

This has the technical advantage for example that it is possible to achieve a particularly effective and sustained reduction of the intensity of the noise emitted by the electrical component.

The controller operates the electrical component within its normal operating power range, in order to ensure advantageous operation of the electrical component. The normal operating power range is the power range in which the electrical component is normally operated, in order to ensure the advantageous and efficient functioning of the electrical component within the refrigeration appliance.

With inventive adaptive noise adjustment the controller changes an operating power of the electrical component within the normal operating power range, in order to determine a minimum for the intensity of the noise of the electrical component detected by the noise sensor. The minimum for the noise intensity is in turn assigned to a specific noise-reduced operating power of the electrical component, with the noise-reduced operating power also being determined by the controller.

An effective reduction of noise intensity is achieved during subsequent operation of the electrical component with the noise-reduced operating power. The noise-reduced operating power is also within the normal operating power range of the electrical component. This means that the noise-reduced operating power is selected from a plurality of advantageous operating powers within the normal operating power range. The noise-reduced operating power therefore ensures a particularly advantageous and efficient operating power as well as noise-reduced operation of the electrical component.

Continuous checking or fresh determination of the noise-reduced operating power can ensure noise-reduced operation of the refrigeration appliance for the user of the refrigeration appliance even over quite a long time period.

It is particularly advantageous if the refrigeration appliance has a number of noise sensors, which are configured to detect noise from different electrical components. The controller can then determine a separate noise-reduced operating power for each different electrical component and operate the respective electrical component with the separate noise-reduced operating power.

A refrigeration appliance refers in particular to a household refrigeration appliance, in other words a refrigeration appliance used for household management in homes or in a catering context, which serves in particular to store food and/or beverages at specific temperatures, for example a refrigerator, freezer, combined refrigerator/freezer, chest freezer or wine chiller cabinet.

In one advantageous embodiment of the refrigeration appliance the electrical component has a maximum operating power within the normal operating power range, the controller is configured to determine a plurality of minima for the noise intensity detected by the noise sensor within the normal operating power range and the controller is configured to determine the noise-reduced operating power based on the minimum that corresponds to an operating power of the electrical component, which is within a tolerance range of the maximum operating power.

This has the technical advantage for example that the noise-reduced operating power determined by the controller ensures both effective noise reduction and operation of the electrical component with maximum operating power. The controller often has a plurality of minima for the detected noise intensity available when determining the noise-reduced operating power, so that the controller can determine different noise-reduced operating powers within the normal operating power range. It is advantageous here however to use the specific minimum that is within a tolerance range of the maximum operating power as the basis for determining the noise-reduced operating power. This not only optimizes operation of the electrical component in respect of minimizing noise but also means that the electrical component can be operated with the maximum operating power.

In a further advantageous embodiment of the refrigeration appliance the normal operating power range has a lower operating power point and an upper operating power point, which delimit the normal operating power range, and the controller is configured to change the operating power of the electrical component from the lower operating power point to the upper operating power point, in order to determine a minimum for the detected noise intensity.

This has the technical advantage for example that continuously changing the operating power of the electrical component from the lower operating power point to the upper operating power point ensures that all the operating powers within the normal operating power range of the electrical component are checked by the controller for the presence of a noise minimum. This ensures that all the relevant operating powers within the normal operating power range are taken into account when determining the noise-reduced operating power.

In a further advantageous embodiment of the refrigeration appliance the noise-reduced operating power corresponds to the operating power of the electrical component, at which the detected noise intensity is below a predefined intensity threshold value, the refrigeration appliance in particular having a manual operating facility with which a user of the refrigeration appliance can change the intensity threshold value.

This has the technical advantage for example that the controller can determine the noise-reduced operating power particularly advantageously, by comparing the detected noise intensities of all the operating powers within the normal operating power range with the predefined intensity threshold value. The manual operating facility allows the user of the refrigeration appliance to adjust the intensity threshold value manually.

In a further advantageous embodiment of the refrigeration appliance the controller is configured to change the operating power of the electrical component within the normal operating power range and to determine a minimum for the detected noise intensity and to determine the noise-reduced operating power during a first time segment and the controller is configured to operate the electrical component with the noise-reduced operating power during a second time segment following the first time segment.

This has the technical advantage for example that it is possible to determine the noise-reduced operating power and to operate the electrical component with the noise-reduced operating power in different time segments. For example the controller can determine the noise-reduced operating power while the user of the refrigeration appliance is asleep, as the user will probably not be in proximity to the refrigeration appliance during this time and therefore will also not be affected by the noise resulting during the change in operating power.

In a further advantageous embodiment of the refrigeration appliance the controller is configured to determine the noise-reduced operating power after the refrigeration appliance has been connected to an electrical power supply and/or the controller is configured to determine the noise-reduced operating power after periodically repeated operating time intervals.

This has the technical advantage for example that after the refrigeration appliance has been connected to the electrical power supply it can be ensured that changes in the noise-reduced operating power occurring during transportation or quite a long stoppage period of the refrigeration appliance can be identified by the controller and the noise-reduced operating power can be determined again. Determination of the noise-reduced operating power after periodically repeated operating time intervals ensures that changes in the noise-reduced operating power can be identified effectively by the controller during ongoing operation of the refrigeration appliance and an updated noise-reduced operating power can be effectively determined.

In a further advantageous embodiment of the refrigeration appliance the controller is configured to repeat the first time segment if the controller fails to determine any change in noise-reduced operating power during the first time segment and the controller is configured to extend the duration of the periodically repeated operating time intervals if the controller fails to determine any change in noise-reduced operating power after the two successive first time segments.

This has the technical advantage for example that in the case of a reduced operating power that does not change during the first time segment, it is possible to determine the noise-reduced operating power in longer time segments by increasing the duration of the periodically repeated operating time intervals.

In a further advantageous embodiment of the refrigeration appliance the refrigeration appliance comprises a refrigerant circuit for cooling a cooling region of the refrigeration appliance, the refrigerant circuit comprising the electrical component, and the electrical component comprising in particular a refrigerant compressor or a fan for cooling a refrigerant condenser of the refrigerant circuit.

This has the technical advantage for example that particularly effective noise reduction can be ensured for particularly loud components, such as the refrigerant compressor or fan for example.

In a further advantageous embodiment of the refrigeration appliance the operating power of the refrigerant compressor or fan corresponds to a motor speed of a motor of the refrigerant compressor or fan, the controller being configured to change the motor speed of the refrigerant compressor or fan within a normal motor speed range and to determine a minimum for the detected noise intensity and to determine a noise-reduced motor speed, in order to operate the refrigerant compressor or fan with the noise-reduced motor speed.

This has the technical advantage for example that controlling the motor speed of the fan or refrigerant compressor ensures particularly effective and noise-reduced operation of the refrigeration appliance.

In a further advantageous embodiment of the refrigeration appliance the electrical component comprises a movable flap for closing an air duct of the refrigeration appliance or a valve for closing a fluid-conveying line within the refrigeration appliance.

This has the technical advantage for example that it ensures particularly effective noise reduction for the movable flap or the valve.

In a further advantageous embodiment of the refrigeration appliance the noise sensor comprises an acoustic sensor for detecting noise emitted by the electrical component and/or a vibration sensor for detecting vibrations emitted by the electrical component and the noise sensor in particular comprises a piezo vibration sensor.

This has the technical advantage for example that an acoustic sensor allows particularly effective detection of noise transmitted by the air and a vibration sensor allows particularly effective detection of vibrations emitted by the electrical component.

In a further advantageous embodiment of the refrigeration appliance the noise sensor is positioned on an inner surface or outer surface of the refrigeration appliance and/or the noise sensor is positioned on the electrical component.

This has the technical advantage for example that a direct arrangement of the noise sensor on the electrical component allows particularly effective noise detection by the noise sensor. If the noise sensor is positioned on the inner or outer surface of the refrigeration appliance, noise can be detected effectively by the transmission of noise by the air or the transmission of vibrations by the refrigeration appliance.

In a further advantageous embodiment of the refrigeration appliance the noise sensor is positioned on an inner surface of the refrigeration appliance and the noise sensor comprises a temperature detection element for detecting a temperature within a cooling region of the refrigeration appliance.

This has the technical advantage for example that the noise sensor is configured as a dual sensor, which detects temperature in the cooling region as well as detecting noise. This takes up less space in the refrigeration appliance, as only one sensor has to be used for two functions.

In a further advantageous embodiment of the refrigeration appliance the controller has a memory for storing the noise-reduced operating power, the controller being configured to operate the electrical component with the stored noise-reduced operating power.

This has the technical advantage for example that the controller can advantageously store the determined noise-reduced operating power in the memory, in order to operate the electrical component with the stored noise-reduced operating power at a later time point.

According to a second aspect the object of the invention is achieved by a method for reducing noise in a refrigeration appliance, wherein the refrigeration appliance has an electrical component, which emits noise during operation, a noise sensor for detecting an intensity of noise emitted by the electrical component and a controller for operating the electrical component in a normal operating power range, wherein the method has the following steps: the controller changing an operating power of the electrical component within the normal operating power range, in order to determine a minimum for the noise intensity detected by the noise sensor, the controller determining the noise-reduced operating power based on the determined minimum for the noise intensity and the controller operating the electrical component with the noise-reduced operating power.

This has the technical advantage that it ensures particularly effective noise reduction for the electrical component.

In one advantageous embodiment of the method the changing of the operating power of the electrical component and the determination of the noise-reduced operating power are performed by the controller during a first time segment and the operation of the electrical component with the noise-reduced operating power is performed by the controller during a second time segment following the first time segment.

This has the technical advantage that the determination of the noise-reduced operating power by the controller can be performed at a different time point from the operation of the electrical component with the noise-reduced operating power.

BRIEF DESCRIPTION OF THE SEVERAL VIEWS OF THE DRAWING

Further exemplary embodiments are described with reference to the accompanying drawings, in which.

DESCRIPTION OF THE INVENTION

Figure 1:
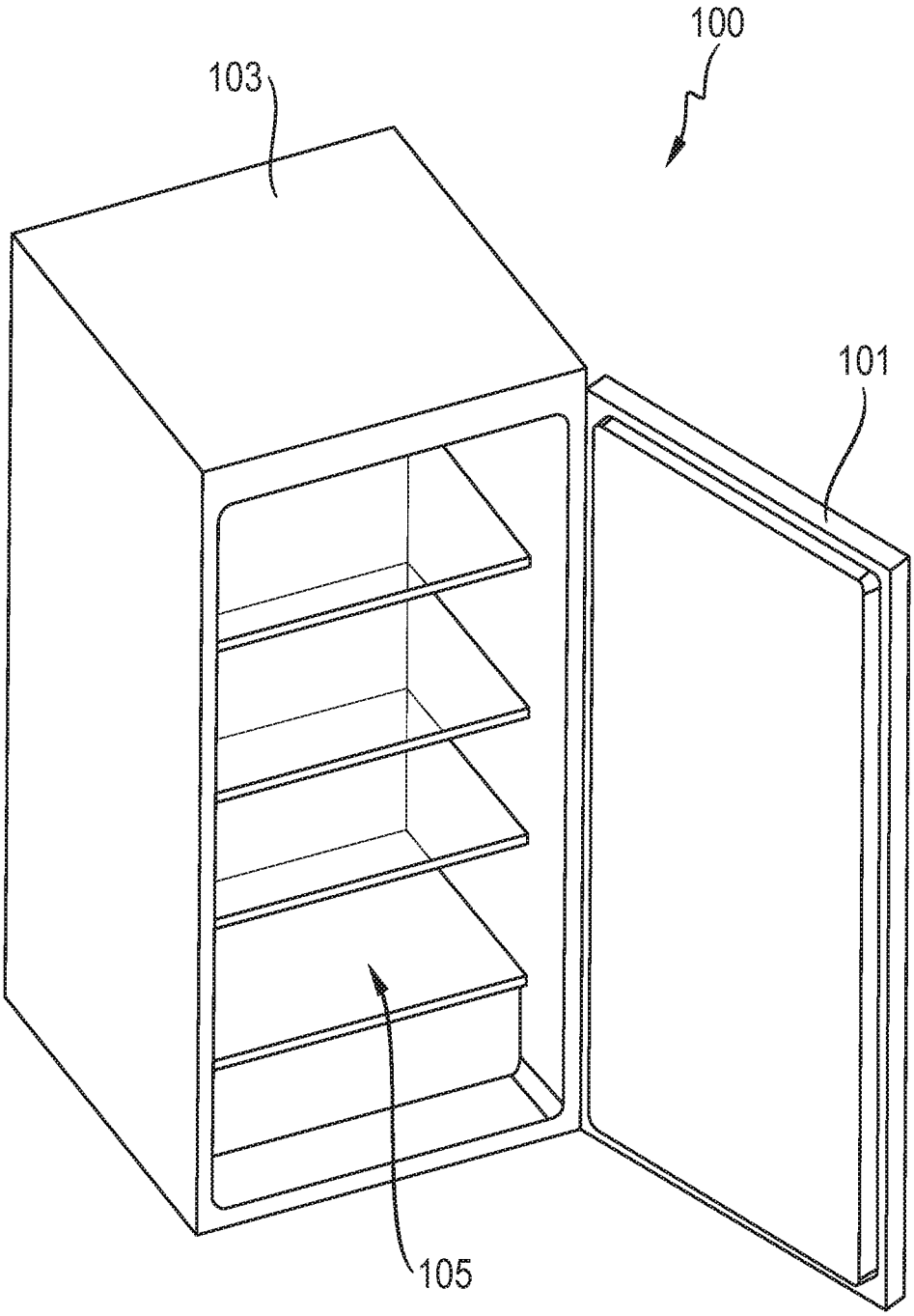
FIG. 1 shows a schematic diagram of a refrigeration appliance.

FIG. 1 shows a refrigerator representing a general refrigeration appliance 100, with a refrigeration appliance door 101 and with an appliance outer wall 103. The refrigeration appliance door 101 is configured to close off a cooling region 105 of the refrigeration appliance 100.

The refrigeration appliance 100 comprises one or more refrigerant circuits, each with a refrigerant evaporator, refrigerant compressor, refrigerant condenser and throttle device. The refrigerant evaporator is a heat exchanger, in which the liquid refrigerant expands before absorbing heat from the cooling medium, e.g. air, which causes it to evaporate. The refrigerant compressor is a mechanically operated component, which takes in refrigerant vapor from the refrigerant evaporator and ejects it to the refrigerant condenser at a higher pressure. The refrigerant condenser is a heat exchanger, in which the evaporated refrigerant is compressed before emitting heat to an external cooling medium, e.g. air, causing it to condense. The refrigeration appliance 100 comprises a ventilator, which is configured to supply a flow of air to the refrigerant condenser and the refrigerant evaporator. The flow of air ensures an effective supply of heat to the refrigerant evaporator. The throttle device is an apparatus for constantly reducing pressure by narrowing the cross section. The refrigerant is a fluid, which is used to transmit heat in the refrigerant circuit, which absorbs heat when the fluid is at low temperature and low pressure and emits heat when the fluid is at higher temperature and higher pressure, generally including changes of state of the fluid.

Figure 2:
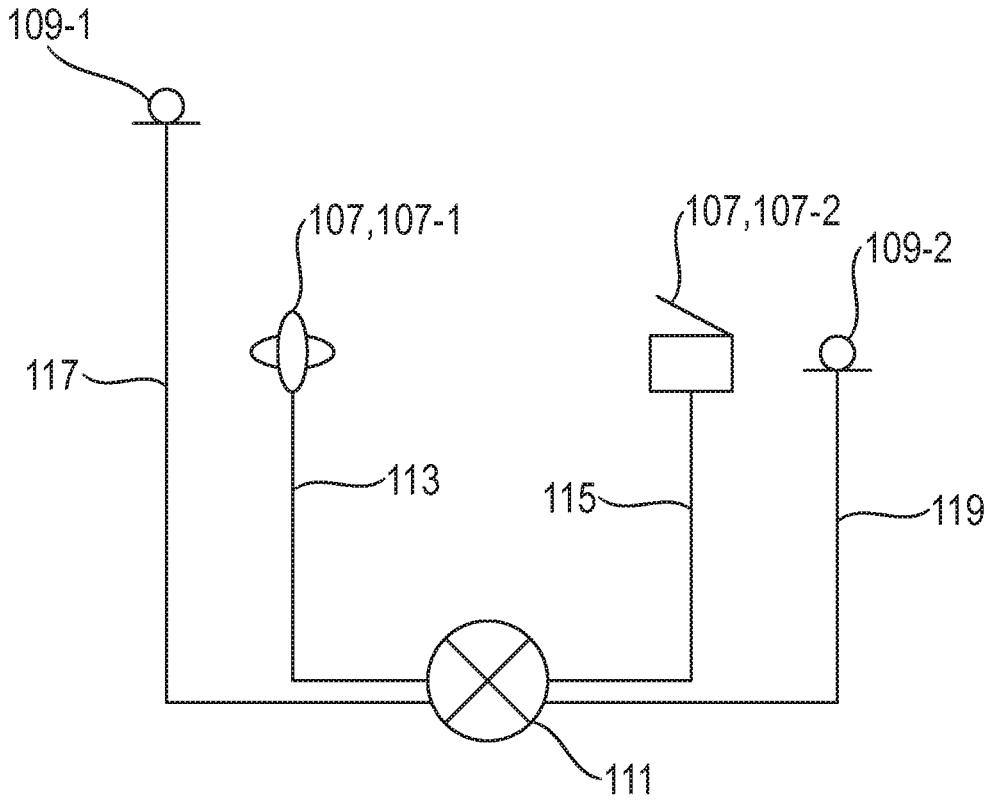
FIG. 2 shows a schematic diagram of a refrigeration appliance with noise sensors.

FIG. 2 shows a schematic diagram of a refrigeration appliance with noise sensors. Arranged in the inventive refrigeration appliance 100 are a first electrical component 107-1 and a second electrical component 107-2. The refrigeration appliance 100 also comprises a first noise sensor 109-1 for detecting an intensity of noise emitted by the first electrical component 107-1 and a second noise sensor 109-2 for detecting an intensity of noise emitted by the second electrical component 107-2. Also arranged in the refrigeration appliance 100 is a controller 111, which is connected to the first electrical component 107-1 by a first appliance line 113, to the second electrical component 107-2 by a second appliance line 115, to the first noise sensor 109-1 by a first sensor line 117 and to the second noise sensor 109-2 by a second sensor line 119.

The refrigeration appliance 100 comprises a plurality of electrical components 107-1, 107-2, which are controlled for example by an electric motor and comprise movable elements, which generate noise, which can in turn be perceived as unpleasant by a user of the refrigeration appliance 100. For example the electrical components 107-1, 107-2 can comprise a refrigerant compressor of a refrigerant circuit of the refrigeration appliance 100, a fan for ventilating a refrigerant condenser of the refrigerant circuit, or flaps or valves of the refrigeration appliance 100.

Structure-borne sound insulation used in conventional refrigeration appliances 100 for the electrical components 107-1, 107-2 can often not be adequate for functional reasons relating to the refrigeration appliance 100, for example because it might restrict cooling capacity, and/or for space and cost reasons.

If the movement of the electrical components 107-1, 107-2 produces structural resonance in the refrigeration appliance 100, the sound emitted is particularly loud. Structural resonance is a function of the size and shape of the refrigeration appliance 100, the way in which the electrical components 107-1, 107-2 are fastened, and the materials used. Even small deviations in fastening, for example sequence of screws or slight tilting of a component against the refrigeration appliance 100, can have a major impact on the frequency range and intensity of excitation of structural resonance.

The scattering of the configuration of the electrical components 107-1, 107-2 can be very wide, with the result that structural resonance is frequently excited in the appliance, often resulting in wide scattering of the noise emitted by the refrigeration appliances 100.

The noise sensors 109-1, 109-2 can be arranged directly on the electrical components 107-1, 107-2, in proximity to them or far away from them. The noise sensors 109-1, 109-2 can be located inside and outside the refrigeration appliance 100. Standard positions are located on an inner surface of the refrigeration appliance 100 or an outer surface of the refrigeration appliance 100. The positioning of the noise sensors 109-1, 109-2 on the appliance wall 103 of the refrigeration appliance 100 is advantageous in that the surface vibration can be identified and used and therefore simple, cost-effective sensors, such as piezo vibration sensors for example, can be used.

Multifunction noise sensors 109-1, 109-2 can also be used, for example those that measure temperature and airborne sound at the same time. This allows a number of functions of electrical components 107-1, 107-2 to be regulated simultaneously. In principle the noise sensors 109-1, 109-2 must be positioned at points which allow noise emitted by the electrical components 107-1, 107-2 to be calculated from the measurement signal from the noise sensors 109-1, 109-2. This must be ensured in respect of size, configuration and materials for every type of refrigeration appliance 100 in a refrigeration appliance series.

During a standard test of the noise intensity of the electrical components 107-1, 107-2 the electrical components 107-1, 107-2 are actuated individually by the controller 111 and the operating power of the electrical components 107-1, 107-2, e.g. the speed of a fan, is changed within a normal operating power range of the electrical components 107-1, 107-2. The controller 111 uses the measurement signals from the corresponding noise sensors 109-1, 109-2 to determine a minimum for the noise intensity detected by the noise sensor 109-1, 109-2 and a noise-reduced operating power of the electrical components 107-1, 107-2 assigned to the minimum within the normal operating power range. Determination of the noise-reduced operating power can be performed during a first time segment.

Determination of the noise-reduced operating power by the controller 111 allows the electrical components 107-1, 107-2 to be advantageously operated with the noise-reduced operating power during a second time segment following the first time segment and the noise emitted by the electrical components 107-1, 107-2 to be advantageously reduced.

The first time segment for determining the noise-reduced operating power can be performed by the controller 111 regularly during operation of the refrigeration appliance 100 by the user, in order to compensate for example for changes due for example to transportation of the refrigeration appliance 100. If there is no change after two successive first time segments, the time segments between the test intervals can be extended.

The inventive controller 111 allows refrigeration appliances 100 to be operated with less noise and reducing the noise from the electrical components 107-1, 107-2 means that users accept refrigeration appliances 100 more readily. Also refrigeration appliances 100 can be produced more economically as there is no need for additional noise-reducing measures. Also refrigeration appliances 100 can be configured more advantageously, as there is no need for extra noise-reducing measures. Refrigeration appliances 100 therefore operate in the acoustic optimum, as there is continuous and regular optimization of noise intensity.

Figure 3:
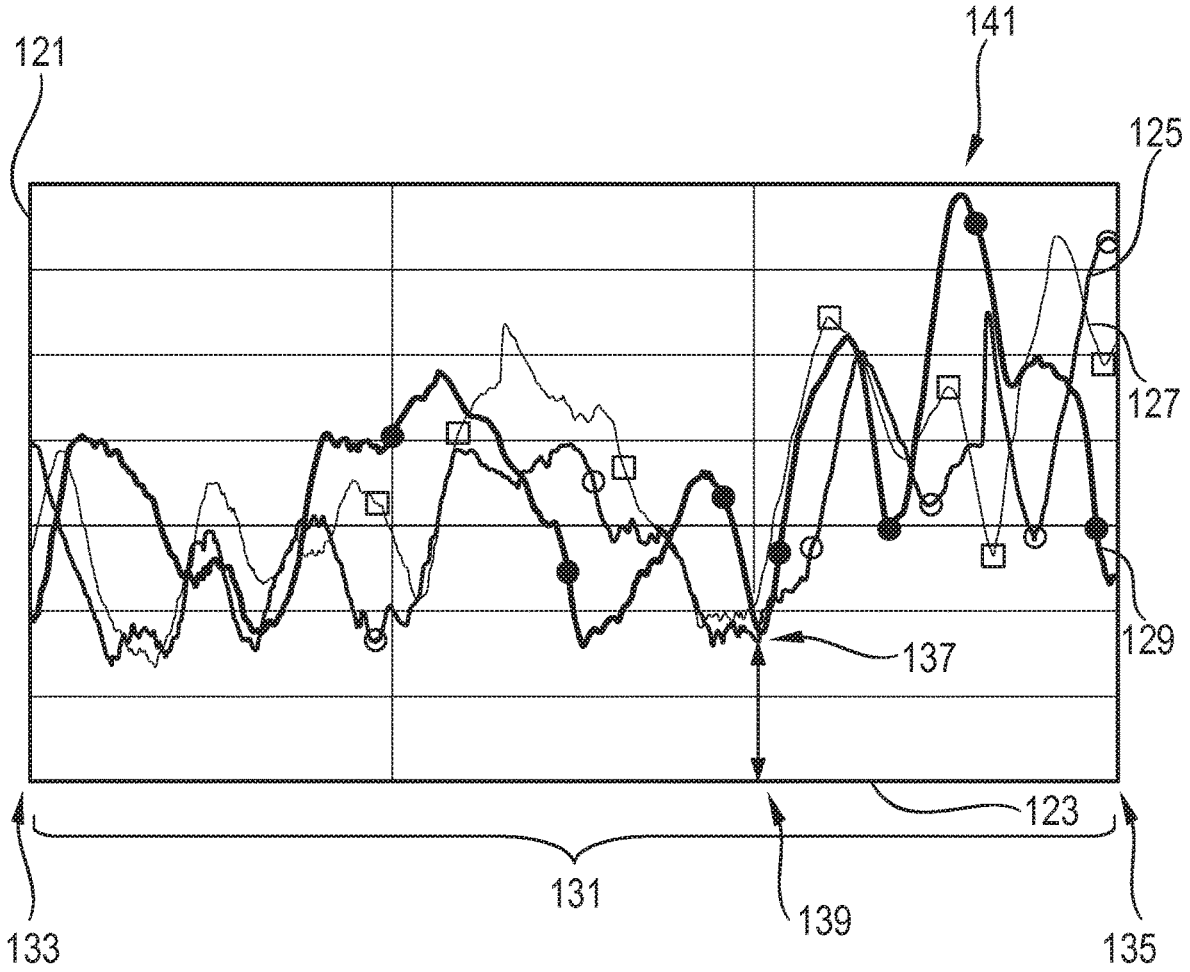
FIG. 3 shows a schematic diagram of the determination of a noise-reduced operating power of an electrical component within a refrigeration appliance.

FIG. 3 shows a schematic diagram of the determination of a noise-reduced operating power of an electrical component within a refrigeration appliance. FIG. 3 shows a diagram over time of the noise intensities of electrical components 107-1, 107-2, shown along the y-axis 121, as a function of operating power, which is shown along the x-axis 123.

The first curve 125 shows the intensity of noise from a first fan of the refrigeration appliance 100 as a function of the motor speed of the fan. The second curve 127 shows the intensity of noise from a second fan of the refrigeration appliance 100 as a function of the motor speed of the second fan. The third curve 129 shows the intensity of noise from a third fan of the refrigeration appliance 100 as a function of the motor speed of the third fan.

It can be seen in FIG. 3 that slight fluctuations in the motor speed of different electrical components 107-1, 107-2 can produce very different noise intensities. Slightly different geometries of the first, second and third fans, which originate from different production batches, mean that there is also a different noise intensity profile as a function of fan motor speed for the first fan, the second fan and the third fan.

In the present instance the operating power, in this instance the motor speed, of the electrical components 107-1, 107-2, in this instance the fans of the refrigeration appliance 100, were changed within the normal operating power range 131 of the electrical components 107-1, 107-2 during a first time segment. In this instance the normal operating power range 131 corresponds to a motor speed range between 1500 rpm and 1650 rpm and is sufficient to ensure effective operation of the fan. The normal operating power range 131 here has a lower operating power point 133 and an upper operating power point 135. The lower and upper operating power points 133, 135 therefore delimit the normal operating power range 131.

The controller 111 determines a minimum 137 for the noise intensity detected by the noise sensors 109-1, 109-2 and determines a noise-reduced operating power 139, which is assigned to the minimum 137. In the present instance there is only a small difference in motor speed between the minimum 137 and a maximum 141 for the detected noise intensity. Nevertheless there is a large acoustic fluctuation between the minimum 137 and maximum 141 for the detected noise intensity.

The advantageous determination of the noise-reduced operating power 139 during the first time segment allows the controller 111 to ensure operation of the electrical components 107-1, 107-2 with the noise-reduced operating power 139 during a second time segment following the first time segment.

Figure 4:
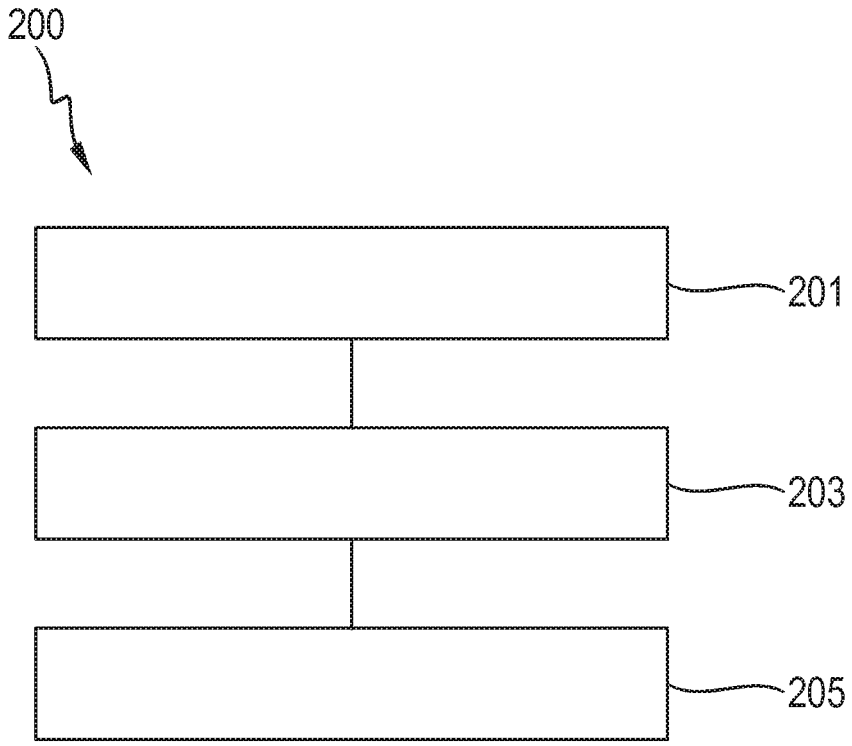
FIG. 4 shows a schematic diagram of a method for reducing noise in a refrigeration appliance.

FIG. 4 shows a schematic diagram of a method for reducing noise in a refrigeration appliance. The method 200 comprises the following method steps: the controller 111 changing 201 an operating power of the electrical component 107-1, 107-2 within the normal operating power range 131, in order to determine a minimum 137 for the noise intensity detected by the noise sensor 109-1, 109-2; the controller 111 determining 203 the noise-reduced operating power 139 based on the determined minimum 137 and the controller 111 operating 205 the electrical component 107-1, 107-2 with the noise-reduced operating power 139.

All the features described and illustrated in conjunction with individual embodiments of the invention can be provided in different combinations in the inventive subject matter, in order to bring about their advantageous effects simultaneously.

The scope of protection of the present invention is defined by the claims and is not limited by the features described in the description or illustrated in the figures.

LIST OF REFERENCE CHARACTERS

100 Refrigeration appliance
101 Refrigeration appliance door
103 Appliance outer wall
105 Cooling region
107 Electrical component
107-1 First electrical component
107-2 Second electrical component
109-1 First noise sensor
109-2 Second noise sensor
111 Controller
113 First appliance line
115 Second appliance line
117 First sensor line
119 Second sensor line
121 y-axis
123 x-axis
125 First curve
127 Second curve
129 Third curve
131 Normal operating power range
133 Lower operating power point
135 Upper operating power point
137 Minimum for the detected noise intensity
139 Noise-reduced operating power
141 Maximum for the detected noise intensity
200 Method for reducing noise in a refrigeration appliance
201 Changing an operating power of the electrical component, in order to determine a minimum for the noise intensity detected by the noise sensor
203 Determining the noise-reduced operating power based on the determined minimum
205 Operating the electrical component with noise-reduced operating power

The invention claimed is:

1. A refrigeration appliance, comprising:

an electrical component, which emits noise during operation, said electrical component having a normal operating power range and a maximum operating power within the normal operating power range;

a noise sensor for detecting a noise intensity of the noise emitted by said electrical component;

a controller for operating said electrical component in the normal operating power range, said controller being configured to change an operating power of said electrical component within the normal operating power range, to determine a a plurality of minima for the noise intensity detected by said noise sensor within the normal operating power range; and said controller being configured to determine a noise-reduced operating power based on the minimum that corresponds to an operating power of said electrical component that lies within a tolerance range of the maximum operating power, and to operate said electrical component with the noise-reduced operating power.

2. The refrigeration appliance according to claim 1, wherein the normal operating power range includes a lower operating power point and an upper operating power point, which delimit the normal operating power range, and said controller is configured to change the operating power of said electrical component from the lower operating power point to the upper operating power point, in order to determine the minimum for the detected noise intensity.

3. The refrigeration appliance according to claim 1, wherein the noise-reduced operating power corresponds to the operating power of said electrical component at which the detected noise intensity is below a predefined intensity threshold value, and wherein the refrigeration appliance further comprises a manual operating facility for enabling a user of the refrigeration appliance to change the intensity threshold value.

4. The refrigeration appliance according to claim 1, wherein:

said controller is configured to change the operating power of said electrical component within the normal operating power range and to determine the minimum for the detected noise intensity and to determine the noise-reduced operating power during a first time segment; and said controller is configured to operate said electrical component with the noise-reduced operating power during a second time segment following the first time segment.

5. The refrigeration appliance according to claim 4, wherein said controller is configured to determine the noise-reduced operating power after the refrigeration appliance has been connected to an electrical power supply, or said controller is configured to determine the noise-reduced operating power after periodically repeated operating time intervals.

6. The refrigeration appliance according to claim 5, wherein said controller is configured to repeat the first time segment, if said controller fails to determine any change in the noise-reduced operating power during the first time segment and said controller is configured to extend a duration of the periodically repeated operating time intervals if said controller fails to determine any change in noise-reduced operating power after the two successive first time segments.

7. The refrigeration appliance according to claim 1, which comprises a refrigerant circuit for cooling a cooling region of the refrigeration appliance, said electrical component forming a part of said refrigerant circuit.

8. The refrigeration appliance according to claim 7, wherein said electrical component is a refrigerant compressor or a fan for cooling a refrigerant condenser of said refrigerant circuit.

9. The refrigeration appliance according to claim 1, wherein said electrical component comprises a movable flap for closing an air duct of the refrigeration appliance or a valve for closing a fluid-conveying line within the refrigeration appliance.

10. The refrigeration appliance according to claim 1, wherein said noise sensor comprises an acoustic sensor for detecting noise emitted by said electrical component or a vibration sensor for detecting vibrations emitted by said electrical component.

11. The refrigeration appliance according to claim 1, wherein said noise sensor comprises a piezo vibration sensor.

12. The refrigeration appliance according to claim 1, wherein said noise sensor is positioned on an inner surface or outer surface of the refrigeration appliance or said noise sensor is positioned on said electrical component.

13. The refrigeration appliance according to claim 12, wherein said noise sensor is positioned on an inner surface of the refrigeration appliance and said noise sensor comprises a temperature detection element for detecting a temperature within a cooling region of the refrigeration appliance.

14. The refrigeration appliance according to claim 1, wherein said controller includes a memory for storing the noise-reduced operating power and said controller is configured to operate said electrical component with the stored noise-reduced operating power.

15. A method for reducing noise in a refrigeration appliance, the refrigeration appliance having an electrical component that emits noise during operation, the method comprising:

detecting with a noise sensor a noise intensity of noise emitted by the electrical component;

the electrical component having a normal operating range and a maximum operating power within the normal operating power range;

operating the electrical component with a controller in the normal operating power range;

changing with the controller an operating power of the electrical component within the normal operating power range, in order to determine a plurality of minima for the noise intensity detected by the noise sensor within the normal operating power range;

determining with the controller a noise-reduced operating power based on the minimum for the noise intensity that corresponds to an operating power of the electrical component that lies within a tolerance range of the maximum operating power; and operating the electrical component with the controller at the noise-reduced operating power.

16. The method according to claim 15, which comprises changing the operating power of the electrical component and determining the noise-reduced operating power with the controller during a first time segment and operating the electrical component with the noise-reduced operating power by the controller during a second time segment following the first time segment.

17. A refrigeration appliance, comprising:

an electrical component, which emits noise during operation;

a noise sensor for detecting a noise intensity of the noise emitted by said electrical component;

a controller for operating said electrical component in a normal operating power range, said controller being configured to change an operating power of said electrical component within the normal operating power range, to determine a minimum for the noise intensity detected by said noise sensor and to determine a noise-reduced operating power and to operate said electrical component with the noise-reduced operating power;

wherein:

said controller is configured to change the operating power of said electrical component within the normal operating power range and to determine the minimum for the detected noise intensity and to determine the noise-reduced operating power during a first time segment;

said controller is configured to operate said electrical component with the noise-reduced operating power during a second time segment following the first time segment;

said controller is configured to determine the noise-reduced operating power after the refrigeration appliance has been connected to an electrical power supply, or said controller is configured to determine the noise-reduced operating power after periodically repeated operating time intervals; and said controller is configured to repeat the first time segment, if said controller fails to determine any change in the noise-reduced operating power during the first time segment and said controller is configured to extend a duration of the periodically repeated operating time intervals if said controller fails to determine any change in noise-reduced operating power after the two successive first time segments.

* * * * *